United States Patent [19]

Scheftic et al.

[11] Patent Number: 4,933,152

[45] Date of Patent: Jun. 12, 1990

[54] CONTINUOUS PROCESS FOR PURIFYING MOLYBDENUM

[75] Inventors: Judy L. Scheftic, S. Waverly; James N. Christini, Towanda, both of Pa.

[73] Assignee: GTE Products Corporation, Stamford, Conn.

[21] Appl. No.: 311,261

[22] Filed: Feb. 16, 1989

[51] Int. Cl.[5] ..... C01G 39/00

[52] U.S. Cl. ..... 423/56; 423/53

[58] Field of Search ..... 423/53, 55, 56, 593

[56] References Cited

U.S. PATENT DOCUMENTS

| | | | |
|---|---|---|---|
| 4,525,331 | 6/1985 | Cheresnowsky et al. | 423/54 |
| 4,612,172 | 9/1986 | Brunelli et al. | 423/56 |
| 4,643,884 | 2/1987 | Cheresnowsky et al. | 423/53 |

*Primary Examiner*—Robert L. Stoll
*Assistant Examiner*—Wayne A. Langel
*Attorney, Agent, or Firm*—Donald R. Castle; L. Rita Quatrini

[57] ABSTRACT

A process for purifying molybdenum, which comprises first leaching impure molybdenum trioxide containing potassium in a liquid medium of nitric acid, and an ammoniacal liquor, wherein the nitric acid concentration is about 3.5 to 4.0 moles per liter and the ammonium nitrate concentration is about 0.5 to 1.0 moles per liter, at greater than 50° C. to solubilize the major portion of the potassium and produce a once-leached molybdenum trioxide and a first liquor, removing the once-leached molybdenum oxide from the first liquor, re-leaching the once-leached molybdenum trioxide in nitric acid having a concentration of about 3.5 to 4.0 moles per liter, at greater than 50° C. to produce a twice-leached molybdenum trioxide and a second liquor, removing the twice-leached molybdenum oxide from the second liquor, water washing the twice-leached molybdenum trioxide, digesting the molybdenum trioxide in ammonium hydroxide at greater than 50° C. at a pH of greater than 9.0 to form an ammonium molybdate solution, crystallizing ammonium dimolybdate from the ammonium molybdate solution, separating the ammonium dimolybdate crystals from the spent mother liquor which contains the balance of the starting molybdenum, combining a sufficient amount of spent mother liquor with a sufficient amount of the second liquor to provide the ammonium ion required to maintain the concentration of ammonium nitrate and nitric acid in the liquid medium, and using the combined liquors as the liquid medium in the first leaching step.

5 Claims, 1 Drawing Sheet

CONTINUOUS PROCESS FOR PURIFYING MOLYBDENUM

This invention relates to a continuous process for purifying molybdenum wherein impure molybdenum trioxide is subjected to two nitric acid leaching steps and converted to ammonium dimolybdate (ADM). The nitric acid wash from the second leach step (except for the initial start-up) is recycled continuously to the first leach step of the subsequent cycle resulting in removal of potassium to consistently low levels. The liquor from the crystallization of the ADM is recycled continuously to the first leaching step of the process thereby eliminating disposing of and/or separate processing of the spent liquor to recover the molybdenum.

BACKGROUND OF THE INVENTION

In the processing of impure molybdenum trioxide to pure molybdenum compounds, ammonium dimolybdate leaves spent liquors which contain molybdenum and potassium as an impurity. As a result of this processing, the molybdenum recovered therefrom is high in potassium. Also this spent liquor contains ammonia which would be a problem to store. Another disadvantage of having this spent liquor is the tie up of space, equipment and molybdenum in storing it and this resulting in less efficient throughput.

Therefore, a process in which this spent liquor could be constructively used in recovery of molybdenum would be highly desirable.

SUMMARY OF THE INVENTION

In accordance with one aspect of the invention, there is provided a process for purifying molybdenum which comprises first leaching impure molybdenum trioxide containing potassium in a liquid medium of nitric acid, and an ammoniacal liquor, wherein the nitric acid concentration is about 3.5 to 4.0 moles per liter and the ammonium nitrate concentration is about 0.5 to 1.0 moles per liter, at greater than 50° C. to solulbilize the major portion of the potassium and produce a once-leached molybdenum trioxide and a first liquor, removing the once-leached polybdenum oxide from the first liquor, re-leaching the once-leached molybdenum trioxide in nitric acid having a concentration of about 3.5 to 4.0 moles per liter, at greater than 50° C. to produce a twice-leached molybdenum trioxide and a second liquor, removing the twice-leached molybdenum oxide from the second liquor, water washing the twice-leached molybdenum trioxide, digesting the molybdenum trioxide in ammonium hydroxide at greater than 50° C. at a pH of greater than 9.0 to form an ammonium molydate solution, crystallizing ammonium dimolydate from the ammonium molydate solution, separating the ammonium dimolybdate crystals from the spent mother liquor which contains the balance of the starting molybdenum, combining a sufficient amount of spent mother liquor with a sufficient amount of the second liquor to provide the ammonium ion required to maintain the concentration of ammonium nitrate and nitric acid in the liquid medium, and using the combine liquors as the liquid medium in the first leaching step.

DETAILED DESCRIPTION OF THE INVENTION

Figure 1:
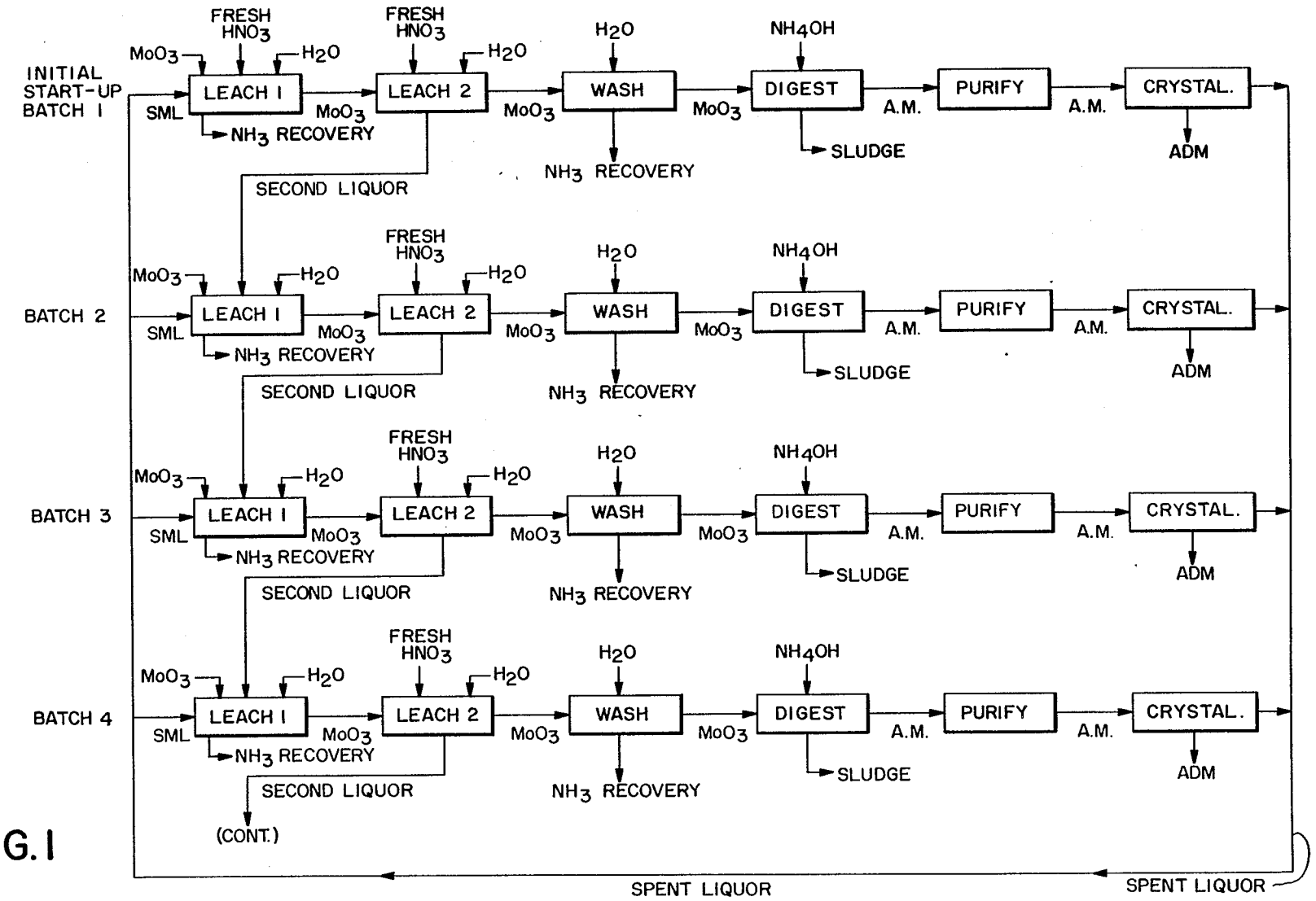
FIG. 1 is a schematic diagram showing the steps of the process of the present invention.

For a better understanding of the present invention, together with other and further objects, advantages and capabilities thereof, reference is made to the following disclosure and appended claims in connection with the above described drawing and description of some of the aspects of the invention.

The present invention affords the use of acid leach and spent liquors from crystallization of ADM advantageously in the processing to obtain pure polybdenum.

The starting impure molybdenum trioxide is a technical grade oxide which typically contains potassium. Other impurities such as arsenic, phosphorus, iron, magnesium, calcium, aluminum, and silicon can be present.

This molybdenum trioxide is first leached in a liquid medium consisting essentially of water, nitric acid, and an ammoniacal liquor. The nitric acid concentration of the liquid medium is from about 3.5 to about 4.0 moles per liter and preferably from about 3.7 to about 3.9 moles per liter. The ammonium nitrate which results from the ammonia content and the nitric acid is present in a concentration of from about 0.5 to about 1.0 moles per liter and preferably from about 0.65 to about 0.70 moles per liter. The slurrying is done for a sufficient time to solubilize the major portion of the potassium. The temperature is greater than about 50° C. and preferably from about 60° C. to about 70° C. and the most preferred conditions are a temperature of about 75°0 C. for about 2 hours. The elevated temperature facilitates the dissolution of the potassium in the liquid medium. Some iron can also be leached out of the molybdenum trioxide. Initially this liquid medium is made up fresh, that is without any spent nitric acid liquors. However, because of continuous processing of molybdenum, the liquid medium is normally made of spent nitric acid liquors as will now be described.

FIG. 1 is a schematic diagram of the steps of the process of the present invention. The first leach step just described is shown as "Leach 1".

The first liquor is then removed from the resulting once-leached molybdenum trioxide by standard techniques such as filtration or, more preferably decantaion. Since the first leach liquid medium is normally made from spent liquors, the standard practice at this point is to subject the resulting first liquor to ammonia recovery by known techniques.

The resulting once-leached molybdenum oxide is then subjected to a re-leaching. The leaching medium used in this step is fresh nitric acid, that is, nitric acid which has not previously been used, and having a concentration of from about 3.0 moles per liter to about 4.0 moles per liter 3.7 to about 3.9 moles per liter. The leaching temperatures and times are the same as for the first leach step. This re-leach step is shown in FIG. 1 as "Leach 2". The resulting liquor is called the second liquor.

The second liquor is then removed from the resulting twice-leached molybdenum trioxide by standard techniques such as filtration or, more preferably decantation.

The second liquor is reused in the present process as will be described.

The twice-leached molybdenum oxide is then water washed to remove water soluble impurities therefrom. This is done by slurrying the oxide in water or by washing it on a filter. The wash water is preferably deionized water and it is preferably hot, at a temperature of about 60° C. to aid the solubilization of the impurities. Most of the wash water is decanted off, leaving a slurry of the twice-leached molybdenum trioxide and the balance of the wash water which is slightly acidic.

At this point the resulting twice-leached molybdenum trioxide can be subjected to any combination of purification steps to remove impurities contained therein. Some examples of typical purification steps will now be described.

A source of magnesium ions such as magnesium nitrate or magnesium hydroxide can be added to the slurry of the twice-leached molybdenum trioxide and wash water to form precipitates of arsenic and phosphorus as their magnesium ammonium salts. Specific techniques for treating molybdenum with magnesium to precipitate magnesium ammonium phosphate and magnesium ammonium arsenate are known in the art. Water is then added to he resulting magensium-treated slurry-usually to result in a solid/liquid weight ratio of about 1 to 1. The pH is then adjusted to greater than about 9, preferably about 9.9 with ammonia or ammonium hydroxide.

It is preferred to oxidize the molybdenum trioxide and any iron which may be present to their highest states. This is done typically by adding hydrogen peroxide and additional water to the pH adjusted molybdenum oxide-water slurry with agitation for a period of time which is usually for about ½ hour.

The resulting water washed molybdenum trioxide is then digested in ammonium hydroxide at a pH of at least about 9 and preferably about 9.9 (measured at about 25° C.), at a digestion temperature of at least about 50° C. and preferably at about 60° C. to about 70° C. for preferably about 2 hours to produce an ammonium molybdate solution. The digestion insures that essentially all of the molybdenum solubilized as ammonium molybdate and that additional impurities such as iron are precipitated.

At this point any insolubles which may have formed can be removed.

The oxidized and magnesium-treated ammonium molybdate solution can be contacted with a chelating iminodiacetate cation exchange resin to remove the positive divalent cations as calcium, copper, magnesium, etc. This is done preferably by passing the solution through a column of the resin and collecting the purified ammonium molybdate effluent.

Ammonium dimolybdate (ADM) is crystallized from the ammonium molybdate solution by evaporating and taking crystal crops.

The crystals are removed from the resulting spent mother liquor by standard techniques and preferably by filtration or decantation.

The ammonium dimolybdate crystals can now be processed by conventional methods to obtain the final molybdenum products such as molybdenum metal, etc.

A sufficient amount of the spent mother liquor which contains the balance of the starting molybdenum is now combined with a sufficient amount of the second liquor which is essentially nitric acid to provide the ammonium ion required to maintain essentially the same concentration of ammonium nitrate and nitric acid that is required in the liquid medium for the first leaching step. This combined liquor is then used as the liquid medium in the first leaching step of the next batch as shown in FIG. 1 as Batch 2.

FIG. 1 shows the steps of continuous processing of four consecutive batches of molybdenum trioxide. The FIGURE shows the liquor of the second leach step of the Batch 2 as being part of the liquid medium of Batch 3. The liquor of the second leach step of Batch 3 is in turn used to make up the liquid medium of Batch 4. Also shown are the spent liquors from the respective crystallization steps of the four batches being recycled to the respective first leach steps.

U.S. Pat. No. 4,525,331 relates to purifying impure molybdenum trioxide of potassium by leaching with nitric acid and thereafter crystallizing ammonium molybdate. There is no teaching of recycling the liquor from the crystallization to the nitric acid leaching step. For example, prior to the present invention, successive lots of ammonium dimolybdate could vary by as much as 100% as far as potassium levels, whereas according to the process of the present invention, potassium levels remain relatively constant and are therefore predictable. Ammonium hydroxide costs are reduced since the ammonia needed in the initial nitric acid leach is contained in the recycled spent mother liquor. The spent liquor is not accumulated since it is being continuously reused in the process. Separate processing of the spent liquor to recover the molybdenum contained therein is eliminated.

To more fully illustrate this invention, the following nonlimiting example is presented.

EXAMPLE

About 505 gallons of concentrated ammonium molybdate solution (the spent liquor from a crystal crop), about 830 gallons of deionized water, and about 475 gallons of about 66% by weight nitric acid are added to a tank while agitating. This results in a solution containing about 23% by weight nitric acid. About 4400 pounds of technical grade molydenum troixide (called oxide Batch 1) containing about 1600 weight ppm potassium is charged to the ammonium nitrate solution. The slurry is heated to about 75° C., leached for about 2 hours on high speed agitation, cooled and settled. The liquor is decanted off the settled oxide and sent to an ammonia recovery system. Water is added to the final volume of settled oxide to bring the total tank volume up to about 500 gallons. In a separate clean tank, about 1315 gallons of about 34% by weight nitric acid solution is made up. After a few minutes agitation, the nitric acid solution is mixed with the settled Batch 1 oxide. This slurry is again heated, leached for about two hours at about 75° C., cooled and settled. This is the second acid leach done on this first batch of molybdenum oxide. This time, the decanted nitric acid solution, (second liquor) is filtered to a clean, empty tank. The twice-acid leached molybdenum trioxide is water washed and ammonia digested to produce an ammonium molybdate solution. To the decanted acid solution (second liquor) which is about 28% by weight $HNO_3$, about 500 gallons of spent ammonium molybdate solution (from a previous crystallization of ADM) is added to form the liquid medium to be used in the first leach of a new batch of molybdenum trioxide. About 4400 pounds of impure (technical grad) molybdenum trioxide is charged to this solution and agitated. This is called molybdenum oxide Batch 2. The molybdenum oxide Batch 2 is leached in this liquid medium at a temperature of 75° C., cooled and settled. The resulting acid leach liquor, (first liquor) is decanted off and sent to an ammonia recovery system. Once again, the volume of settled oxide is brought up to about 500 gallons with deionized water. Enough water and fresh nitric acid are added to the settled oxide to duplicate the 34% by weight HNO3 addition. A second acid leach on oxide Batch 2 is carried out at a temperature of about 75° C., cooled and settled. The acid leach solution, (second liquor) is decanted and filtered to a rinsed empty tank to be combined with spent mother liquor from a previous ADM crystallization and used in a first leach step. The twice-acid leached Batch 2 oxide is then further processed to obtain an ammonium molybdate solution. Once the molybdenum oxide batches 1 and 2 are solubilized into ammonium molybdate solutions they are evaporated together to a crystal crop and separated from the residual concentrated ammonium molybdate solution. The potassium content of the ammonium dimolybdate from this twice-acid leached combined batch of molybdenum oxide is about 56 weight ppm on a MoO3 basis. Control batches on about 4400 pounds of technical grade molybdenum trioxide of the same lot as the above batches are leached one time using about 505 gallons of concentrated ammonium molybdate solution, about 830 gallons of water, and about 475 gallons of nitric acid, and processed per known methods. The final product from a double crystal crop show about 96 weight ppm potassium on a MoO3 basis.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for purifying molybdenum trioxide with a controlled content of potassium, said process comprising:

(a) first leaching impure molybdenum trioxide containing potassium as an impurity, in a liquid medium consisting essentially of nitric acid, and an ammoniacal liquor, wherein the nitric acid concentration of said liquid medium is from about 3.5 to about 4.0 moles per liter and wherein the resultant ammonium nitrate concentration is from about 0.5 to about 1.0 moles per liter, at a temperature of greater than about 50° C. to solubilize the major portion of said potassium and produce a once-leached molybdenum trioxide and a first liquor;

(b) removing said once leached molybdenum oxide from said first liquor;

(c) re-leaching said once-leached molybdenum trioxide in nitric acid having a concentration of from about 3.5 to about 4.0 moles per liter, at a temperature of greater than about 50° C. to produce a twice-leached molybdenum trioxide and a second liquor;

(d) removing said twice-leached molybdenum oxide from said second liquor;

(e) water washing said twice-leached molybdenum trioxide to remove any water soluble impurities contained therein;

(f) digesting the resulting washed molybdenum trioxide in ammonium hydroxide at a temperature of greater than about 50° C. at a pH of greater than about 9.0 to form an ammonium molybdate solution;

(g) crystallizing ammonium dimolybdate from the resulting ammonium molybdate solution;

(h) separating the resulting ammonium dimolybdate crystals having a controlled content of potassium from the resulting spent mother liquor which contains the balance of the starting molybdenum; and (i) combining a sufficient amount of said spent mother liquor with a sufficient amount of said second liquor to provide the ammonium ion required to maintain said concentration of ammonium nitrate and nitric acid in said liquid medium, and using the resulting combined liquors as said liquid medium in said first leaching step of step a.

2. A process of claim 1 wherein said twice-leached molybdenum trioxide is oxidized to insure that the molybdenum is in the highest oxidation state.

3. A process of claim 1 wherein the concentration of said nitric acid in said liquid medium is from about 3.7 to about 3.9 moles per liter.

4. A process of claim 1 wherein the concentration of ammonium nitrate in said liquid medium is from about 0.65 to about 0.70 moles per liter.

5. A process of claim 1 wherein the concentration of nitric acid used to leach said once-leached molybdenum trioxide is from about 3.7 to about 3.9 moles per liter.

* * * * *